US006450482B1

(12) United States Patent
Struck

(10) Patent No.: US 6,450,482 B1
(45) Date of Patent: Sep. 17, 2002

(54) LIFTING DEVICE

(75) Inventor: Detlef Struck, Wuppertal (DE)

(73) Assignee: Yale Industrial Products GmbH, Velbert (DE)

( * ) Notice: Subject to any disclaimer, the term of this patent is extended or adjusted under 35 U.S.C. 154(b) by 0 days.

(21) Appl. No.: 09/928,870

(22) Filed: Aug. 13, 2001

Related U.S. Application Data

(63) Continuation of application No. PCT/DE00/04326, filed on Dec. 2, 2000.

(30) Foreign Application Priority Data

Dec. 13, 1999 (DE) ..... 299 21 880

(51) Int. Cl.[7] ..... B66D 1/20
(52) U.S. Cl. ..... 254/358; 254/372
(58) Field of Search ..... 254/372, 358, 254/366, 380

(56) References Cited

U.S. PATENT DOCUMENTS

| | | | | | |
|---|---|---|---|---|---|
| 3,030,076 A | | 4/1962 | Stevens | | |
| 3,894,720 A | * | 7/1975 | Koji | ..... | 254/358 |
| 4,221,364 A | * | 9/1980 | Nishimura | ..... | 254/358 |
| 4,348,011 A | * | 9/1982 | Honda | ..... | 254/380 |
| 4,436,333 A | * | 3/1984 | Tsuda | ..... | 254/358 |
| 5,007,617 A | * | 4/1991 | Nishimura et al. | ..... | 254/372 |
| 5,125,629 A | * | 6/1992 | Nishimura | ..... | 254/372 |
| 5,544,863 A | * | 8/1996 | Ueno et al. | ..... | 254/372 |
| 5,647,576 A | * | 7/1997 | Kataoka | ..... | 254/372 |

FOREIGN PATENT DOCUMENTS

| | | | | |
|---|---|---|---|---|
| FR | 772 834 A | | 11/1934 | |
| GB | 184623 | * | 8/1922 | ..... 254/358 |
| GB | 188545 | * | 11/1922 | ..... 254/358 |

* cited by examiner

*Primary Examiner*—Emmanuel M. Marcelo
(74) *Attorney, Agent, or Firm*—Henry M. Feiereisen

(57) ABSTRACT

The invention relates to a lifting device for raising, lowering and pulling loads. The lifting device includes a hand chain wheel which can be turned in both directions by a hand chain. The hand chain wheel is coupled to a load wheel, which moves a load chain and a load suspended thereon. The hand chain wheel is covered by a rotatably supported cover with chain guide openings. The cover is rotatably secured by a supporting metal sheet which is located on a side plate of the housing that accommodates the load chain wheel. A radially outwardly oriented guide disposed on the cover engages with a slide ring of the supporting metal sheet. The slide ring has a central recess for the cover.

7 Claims, 4 Drawing Sheets

LIFTING DEVICE

CROSS-REFERENCE TO RELATED APPLICATIONS

This application is a continuation of PCT Application No. PCT/DE00/004326, filed Dec. 2, 2000, which claims the priority of German patent application DE 299 21 880.5 filed Dec. 13,1999.

FIELD OF THE INVENTION

The invention relates in general to a lifting device with a load wheel with a load chain and a hand chain wheel with a hand chain, and more particularly to a lifting device wherein the hand chain wheel is covered with a cover which is supported for rotation about the hand chain wheel and has chain guide openings.

BACKGROUND OF THE INVENTION

U.S. Pat. No. 3,030,076 discloses a lifting device in form of a hoist or pulley block with a separately guided load and a hand chain, wherein the hand chain wheel is covered with a one-piece hand chain wheel housing which surrounds the hand chain wheel. That hand chain wheel housing is supported for rotation about the hand chain wheel and has chain guide openings for feeding and withdrawing the hand chain.

The rotatable arrangement of the hand chain wheel housing is intended to enable the chain guide openings to follow the pulling forces that act on the hand chain, so that the chain guide openings are approximately perpendicular to the pulling direction. The hand chain has then sufficient clearance for passing through the chain guide openings without friction. This arrangement advantageously reduces the friction losses and the pulling forces required for lifting a load.

However, the design of this lifting device, in particular of the cover for the hand chain wheel, is relatively complex. In practice, the chain can jam or jump in spite of the fact that the hand chain wheel housing is able to rotate. This causes the hand chain wheel to jerk or slip and thereby also bangs in the hand chain and the load chain. Moreover, during operation of the hand chain wheel in certain applications, the chain can produce annoying noise.

It would therefore be desirable to improve the design and functionality of a lifting device with a rotatably supported cover for the hand chain wheel.

SUMMARY OF THE INVENTION

According to one aspect of the invention, the cover is rotatably supported by a supporting metal sheet which is attached to a side plate of a housing that receives the load chain wheel. An outwardly oriented guide disposed on the cover engages with a slide ring on the supporting metal sheet. The slide ring has a central recess for the cover.

The guide on the cover is preferably formed as a circumferential collar, which can be formed by an S-shaped edge of the cover edge .

According to another embodiment of the invention, the guide can be formed by an edge seam of the cover edge facing the side plate.

The lifting device according to the invention is characterized by a functional cover for covering the hand chain wheel, wherein the cover is simple and reliably supported for rotation. The cover can be rotated by 360° about the hand chain wheel and follows the pulling forces that act on the hand chain, so that the hand chain is always oriented along the pulling direction. The cover adjusts automatically according to the pulling direction of the hand chain. The lifting device of the invention can be operated from all directions, and the hand chain is no longer deflected on the chain guide openings. The hand chain can run smoothly and with only small friction losses perpendicular through the chain guide openings. The applied pulling force is thereby transferred to the hand chain wheel via the hand chain with low losses.

Advantageously, the cover can also be assembled in a simple manner. The hand chain wheel can be covered using only a few lightweight components. The cover together with the supporting metal sheet is adjusted and secured on the side plate of the housing, preferably with screws.

According to yet another embodiment of the invention, the slide ring is formed by an annular stamped portion of the supporting metal sheet, making fabrication of the device simple and economical.

According to yet another embodiment of the invention, the passage of the hand chain through the chain guide opening can be supported by sliding blocks associated with the chain guide openings. In a particularly preferred embodiment of the lifting device of the invention, the sliding blocks are made of plastic and form a part of a one-piece shell body incorporated in the cover. The shell body is preferably made of polyamide.

The shell body is placed in the cover and installed together with the cover. The shell body moves with the cover when the cover rotates. The sliding blocks reliably guide the hand chain through the chain guide openings. In addition, the sliding blocks also reduce noise. The rattling noise frequently observed during operation of the hand chain is strongly attenuated.

According to still another advantageous embodiment, one end face of the cover has an opening which is closed with a cover plate that is coupled with the hand chain wheel. The cover plate rotates with the hand chain wheel. The hand chain wheel and the load wheel are mounted on the drive shaft, wherein the end of the drive shaft facing the hand chain wheel is accessible via the cover plate.

Further features and advantages of the present invention will be apparent from the following description of preferred embodiments and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

DETAILED DESCRIPTION OF PREFERRED EMBODIMENTS

Figure 1:
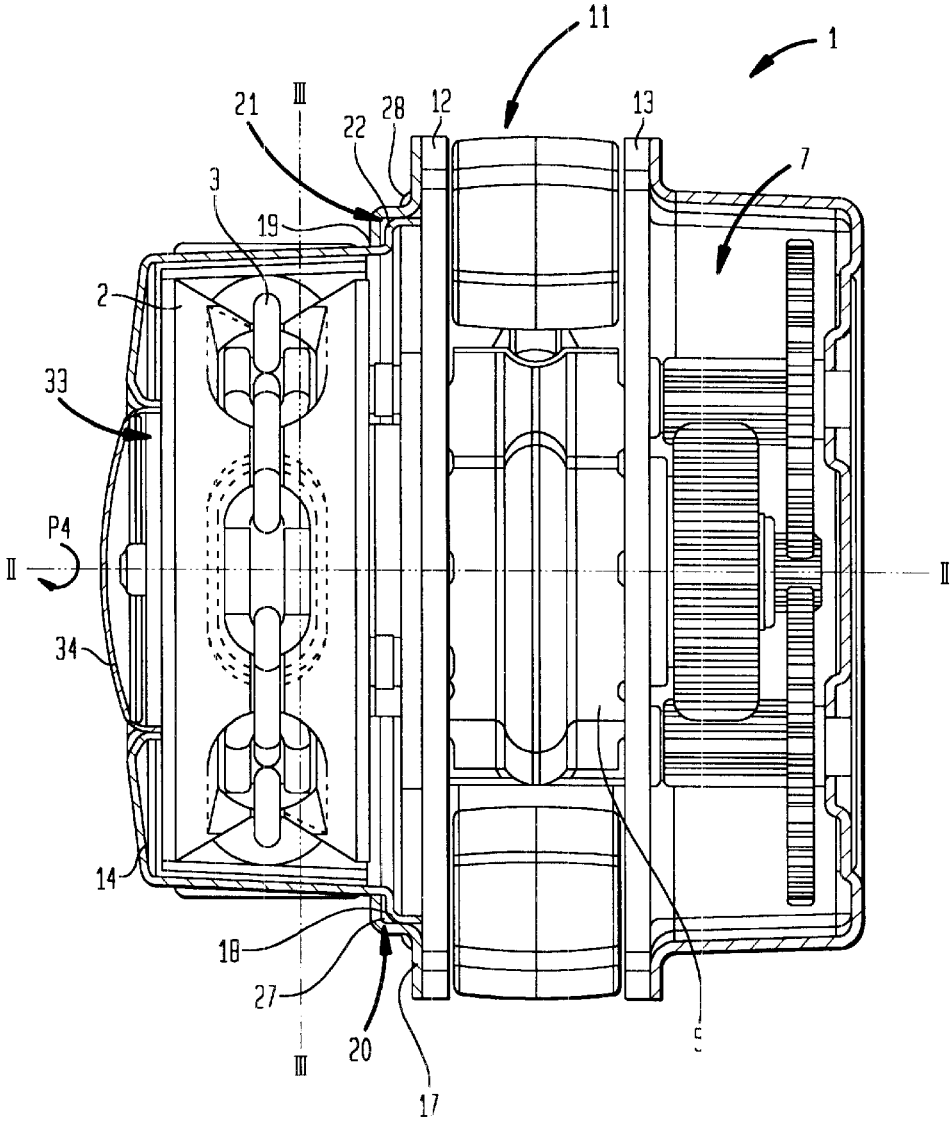
FIG. 1 shows a top view of a lifting device.
Figure 2:
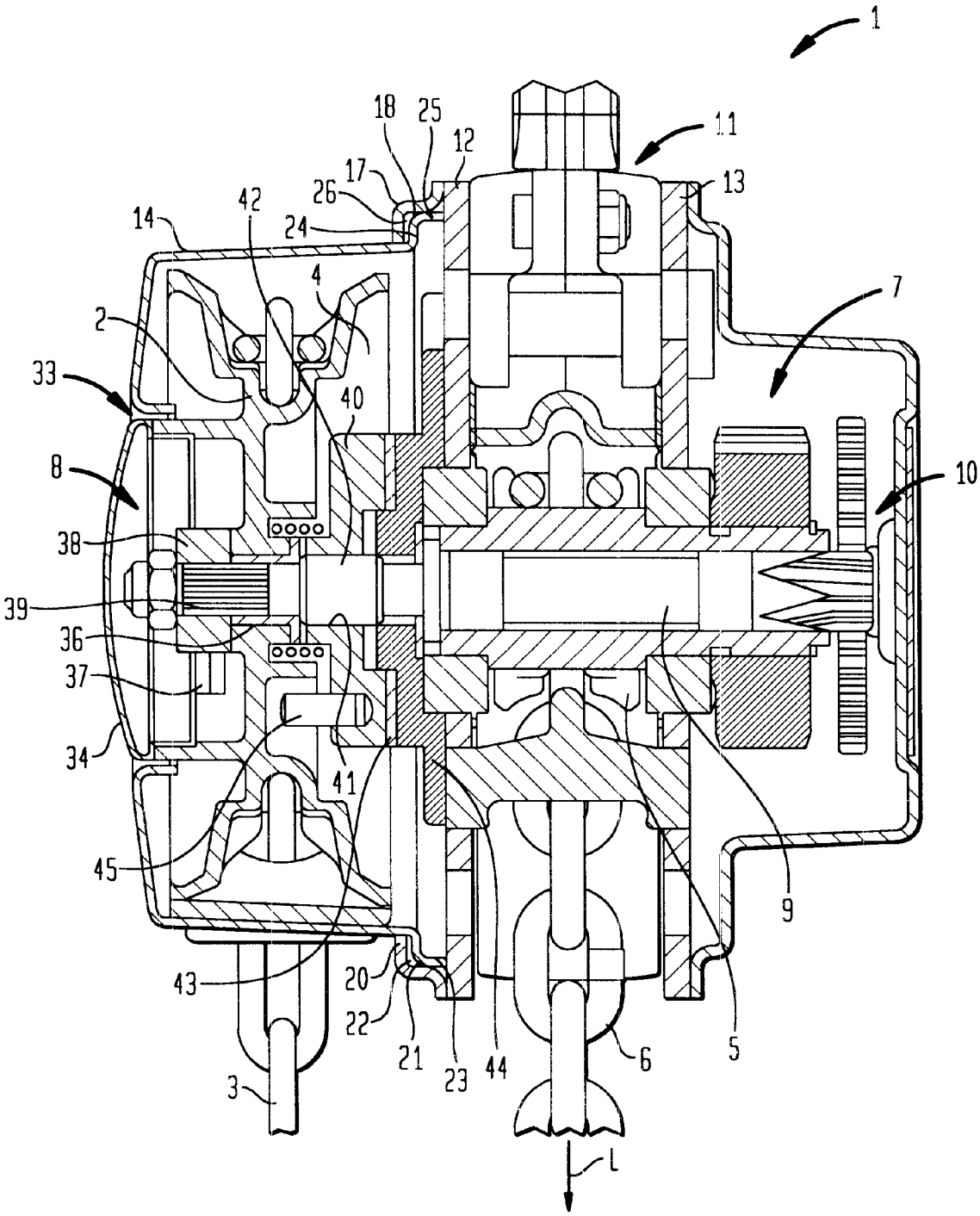
FIG. 2 is a vertical longitudinal section along the line II—II of the diagram of FIG. 1.
Figure 3:
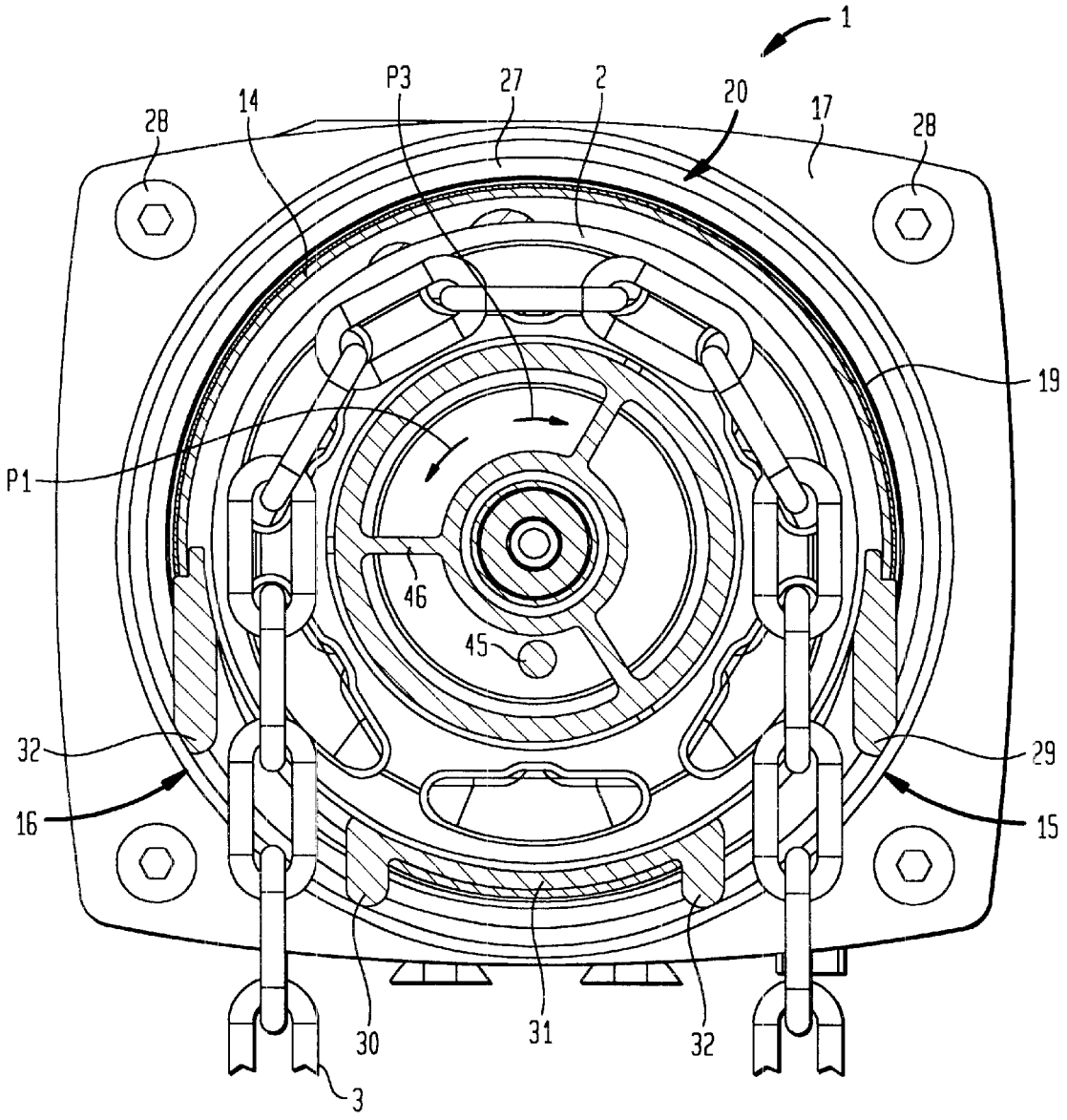
FIG. 3 is a vertical longitudinal section along the line II—II of the diagram of FIG. 1.

FIGS. 1 to 3 to show a lifting device 1 which can be used in different ways for raising, lowering, and pulling loads L or for assembling parts.

Lifting device 1 includes a hand chain wheel 2 with hand chain 3, a friction disc brake 4, a load wheel 5 with load chain 6 and a gear 7, which are arranged sequentially in the axial direction. The hand chain wheel 2 is located at one end 8 of a drive shaft 9. For transmitting torque, the friction disc brake 4 can be coupled with the gear 7 which is located at the other end 10 of the drive shaft 9 and drives the load wheel 5, via the drive shaft 9 which extends through the friction disc brake 4 and the load wheel 5. The load wheel 5 is supported inside a housing 11 between side plates 12 and 13.

The hand chain wheel 2 is rotated by pulling the hand chain 3, thereby transmitting the torque via the drive shaft 9 and the gear 7 to the load wheel 5 for raising and lowering a load. It can be seen that the hand chain wheel 2 is covered by a cover 14 supported for rotation and having two chain guide openings 15, 16. The cover 14 is rotatably supported by a supporting metal sheet 17 which is attached to the side plate 12. A radially outwardly oriented guide 18 of the cover 14 engages with a slide ring 20 of the supporting metal sheet 17. The slide ring 20 is provided with a center recess 19 for the cover 14. The guide 18 is implemented as a circumferential guide collar 21 formed by an S-shaped edge 22 of the cover edge 23 that faces the side plate 12. The edge 22 includes a radial segment 24 and an axial segment 25, with a rounded arcuate section 26 forming a transition between the radial and axial segments. The slide ring 20 is formed by an annular stamped portion 27 on the supporting metal sheet 17. The slide ring 20 has an approximately opposite shape so as to formfittingly engage with the edge 22.

The cover 14 together with the supporting metal sheet 17 is attached to the side plate 12 with screws 28. The cover 14 is reliably guided and rotatably supported through cooperation between the guide 8 and the guide 18 and the slide ring 20.

As seen in particular from FIG. 3, the sliding blocks 29, 30 are associated with the chain guide openings 15, 16. The sliding blocks 29, 30 are a component of a shell body 31 that is made of polyamide and incorporated in the cover 14. The sliding blocks 29, 30 include bead-shaped lips 32, allowing a smooth and quiet passage of the hand chain 3.

The end face of the cover 14 has an opening which is closed by a cover plate 34 that is coupled with the hand chain wheel 2. The cover plate 34 hence rotates with the hand chain wheel 2.

The rotatable arrangement of the cover 14 about the hand chain wheel 2 allows operation of the lifting device 1 from any direction. The cover tips with the hand chain 3 depending on the applied pulling forces. As a result, the hand chain 3 is always fed and withdrawn through the chain guide openings 15,16 in the direction of the applied pulling force, so that the lifting device can operate quietly and with low friction.

Figure 4:
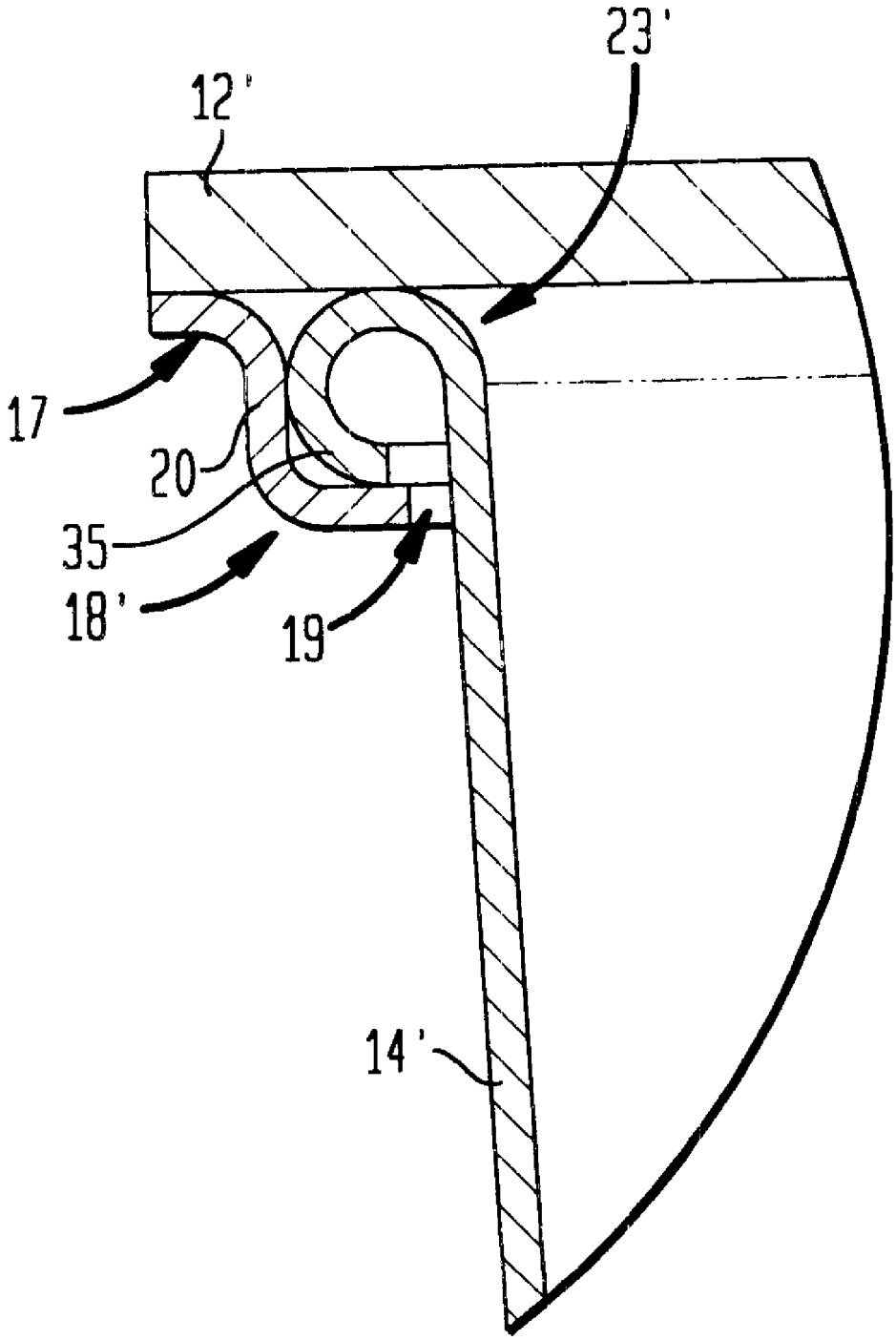
FIG. 4 shows a detail of a guide on a cover in an alternative embodiment.

FIG. 4 shows an alternative embodiment of the guide 18' of a cover 14'. The guide 18' is formed by an annular edge seam 35 of the cover edge 23' facing the side plate 12'. In all other aspects, this embodiment operates in the same manner as the aforedescribed design.

To raise a load L, the hand chain wheel 2 is rotated clockwise in the direction of the arrow P1 of FIG. 1. The hand chain wheel 2 can initially rotate freely relative to the drive shaft on a bushing 36 (see FIG. 2), so that the hand chain wheel 2 moves relative to the drive shaft 9, until projections (not shown) of the hand chain wheel 2 make contact with wings 37 of a wing disc 38. The wing disc 38 is secured against rotation on the drive shaft 9 through a serration 39, so that the drive shaft 9 also rotates clockwise. Accordingly, torque is transferred directly from the hand chain wheel 2 via the drive shaft 9 and the gear 7 to the load wheel 5. The friction disc brake 4 disengages by lifting the brake disc 40 from the brake. The brake disc 40 sits on a section 42 of the drive shaft 9 provided with a right hand motion thread 41 and operates through a friction disc 43 on a pressure disc 44 that is coupled to the load wheel 5. The load L can then be raised without a braking action.

When the hand chain wheel 2 is stopped, the suspended load L causes the load wheel 5 to rotate in the opposite direction, i.e., counterclockwise and in the same sense as the drive shaft 9. As a result, the brake disc 40 is pulled in the direction of arrow P2 against the friction disc 43 which is in turn pulled against the pressure disc 44. The load L is pinned at this height.

To lower the load L, the hand chain wheel 2 is rotated counterclockwise in the direction of arrow P3. After a predetermined rotation angle, a driving pin 45 disposed on the backside of the brake disc 40 comes into contact with a rib 46 of the hand chain wheel 2. The brake disc 40 is hereby moved on the motion thread 41 of the drive shaft and lifted from the friction disc 43 which is in turn lifted from the pressure disc 44. The load L then causes the drive shaft 7 to rotate relative to the hand chain wheel 2, so that the brake disc 40 is pulled against the friction disc 43, braking the load. The load wheel 5 coasts, depending on the degree to which the friction disc brake 4 opens during rotation of the hand chain wheel 2, thereby controllably lowering and braking the load.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed as new and desired to be protected by Letters Patent is set forth in the appended claims:

1. Lifting device comprising:

a housing having a side plate, a load wheel with a load chain, a hand chain wheel with a hand chain, a cover covering the hand chain wheel and being provided with an outwardly oriented guide and a chain guide opening allowing the hand chain to pass through, and a supporting metal sheet having a slide ring with a central recess for the cover, wherein the supporting metal sheet is attached to the side plate and supports the cover for rotation about the hand chain wheel, and wherein the outwardly oriented guide engages with the slide ring.

2. The lifting device of claim 1, wherein the outwardly oriented guide is formed by an S-shaped profile disposed on an edge of the cover facing the side plate.

3. The lifting device of claim 1, wherein the outwardly oriented guide is formed by an edge seam disposed on an edge of the cover facing the side plate.

4. The lifting device of claim 1, wherein the slide ring is formed by an annular stamped portion patterned on the supporting metal sheet.

5. The lifting device of claim 1, further comprising sliding blocks cooperating with the chain guide openings.

6. The lifting device of claim 5, wherein the cover includes a one-piece shell body made of plastic and the sliding blocks are formed as a part of the shell body.

7. The lifting device of claim 1, further comprising a cover plate coupled with the hand chain wheel and adapted to close an opening disposed in an end face of the cover.

* * * * *